United States Patent [19]

Benda

[11] Patent Number: 4,669,794

[45] Date of Patent: Jun. 2, 1987

[54] FUSE BLOCK OUT

[76] Inventor: Steven J. Benda, 6712-B Glendower Rd., Raleigh, N.C. 27612

[21] Appl. No.: 813,528

[22] Filed: Dec. 26, 1985

[51] Int. Cl.[4] ..... H01R 13/44

[52] U.S. Cl. ..... 439/148; 337/210; 337/226; 439/491; 439/831

[58] Field of Search ..... 337/210, 209, 208, 226; 339/36, 38, 113 L, 147 R

[56] References Cited

U.S. PATENT DOCUMENTS 3,588,772 6/1971 Ellsworth et al. ..... 337/210

4,108,522 8/1978 Favale ..... 339/113 L

OTHER PUBLICATIONS

Johnston et al; "Push Button Switch"; Feb. '65, IBM Technical Bulletin, vol. 7, No. 9.

*Primary Examiner*—Eugene F. Desmond

*Assistant Examiner*—Paula A. Austin

*Attorney, Agent, or Firm*—Paul H. Gallagher

[57] ABSTRACT

A single integral molded red plastic article, of star shape, having a central body portion with radiating arms at the ends of which are blocking elements of cylindrical shape. The blocking elements are of different sizes. In use, a selected one the blocking elements is pushed into one of the pair of fuse clips, after the fuse is removed. The selected blocking element is so selected according to the size of the fuse clip. The remaining blocking elements extend outwardly and serve as a grip for handling the article, and as a visual signal.

8 Claims, 9 Drawing Figures

FUSE BLOCK OUT

FIELD OF THE INVENTION

The invention resides in the field of electrical maintenance. Maintenance men in that field must often de-energize certain electrical circuits, and this is often done by opening circuit breakers. This step however usually de-energizes many circuits and more circuits than need to be de-energized, and as a development step leading therefrom, individual circuits would be de-energized by removing fuses, and fuses controlling smaller circuits or circuit portions. Heretofore this latter step involved a "tag-out" step, namely moving a fuse and then tying a warning tag to the fuse clip, warning everyone against replacing a fuse. However this latter step is considered dangerous, because it is difficult for the maintenance man wearing protective gloves, required by regulations, to tie a tag onto the fuse clip, and very often, and probably most often, he removed his gloves to tie the tag. This of course was extremely dangerous and in violation of regulations. The present invention overcomes such difficulties and dangers.

OBJECTS OF THE INVENTION

A broad object of the invention is to provide a block out which effectively prevents the insertion of a fuse that has been removed for disabling a circuit.

Another and more specific object is to provide such a fuse block out of the foregoing character, having the following features and advantages:

1. A separate device is provided that is fitted into position in the same position as the fuse occupies, serving as a visual warning to everyone, and for this purpose being readily visible and conspicuous because it is of danger-indicating red color, it is relatively large, compared to the size of the fuse, and it occupies the position that a fuse occupies and thereby discourages everyone from inserting a fuse which would necessitate removing this device.

2. It provides a means for easily tying a danger tag thereon, by a maintenance man, even with wearing protective gloves.

3. A single block out can be used for any of a number of different sizes of fuses.

4. The device is relatively small, whereby to enable a fuse cabinet door to be readily closed thereover, but being of such design as to provide a convenient handle or gripping means for a maintenance man for putting it into position and removing it therefrom.

5. It adapts itself readily to different designs of clips, including round clips, and knife-like clips, for correspondingly shaped fuses.

DESCRIPTION OF CERTAIN PREFERRED EMBODIMENTS

Figure 4:
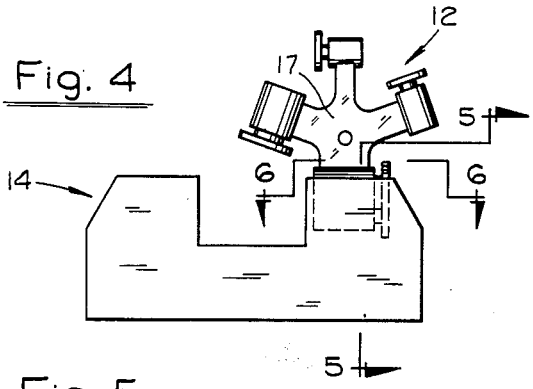
FIG. 4 is a view from the side of FIG. 3.
Figure 3:
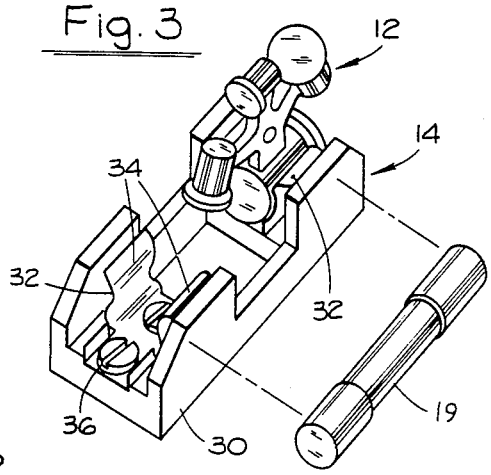
FIG. 3 is a perspective view of a fuse block, with the fuse removed therefrom and the block out in position.
Figure 5:
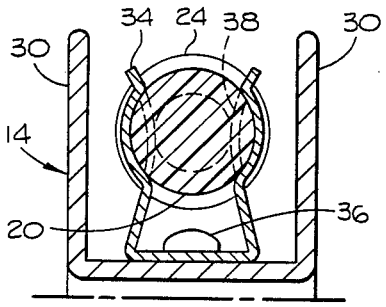
FIG. 5 is a sectional view taken at line 5—5 of FIG. 4.
Figure 6:
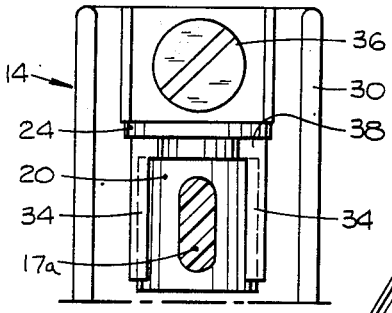
FIG. 6 is a sectional view taken at line 6—6 of FIG. 4.
Figure 7:
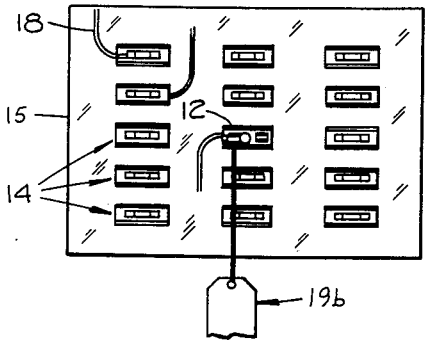
FIG. 7 shows a fuse panel with a number of fuse blocks mounted thereon.

Referring in detail to the drawings, a first form of the device is represented in FIGS. 1–6. The fuse block out itself is indicated at 12 and FIGS. 3 and 4 show it mounted in a fuse block 14 while FIG. 7 shows a plurality of the fuse blocks 14 mounted on a panel 15, which also shows electrical conductors 18 leading to the fuse blocks. FIG. 3 also shows a fuse 19 which is normally mounted in the fuse block, but removed for showing the purposes of the fuse block.

The fuse block 14 and its mounting, and related elements are of course of known character and are illustrated here for purposes of fully illustrating the block out and its functioning.

The block out 12 is a single integral piece or member or item, preferably of plastic material, and molded in a suitable molding operation. The plastic material is of high dielectric characteristics, and of great strength. It is also of danger-indicating, bright red color.

The block out or device 12 includes a body 17 or center, having a plurality of radiating arms 17*a*, on the ends of which are blocking elements 16. The body is provided with a hole 19*a* adjacent its center for tying a danger tag 19*b* (see also FIG. 7) on the device.

The blocking elements 16 are of different sizes, and the arms 17*a* may be of correspondingly different sizes.

Figure 1:
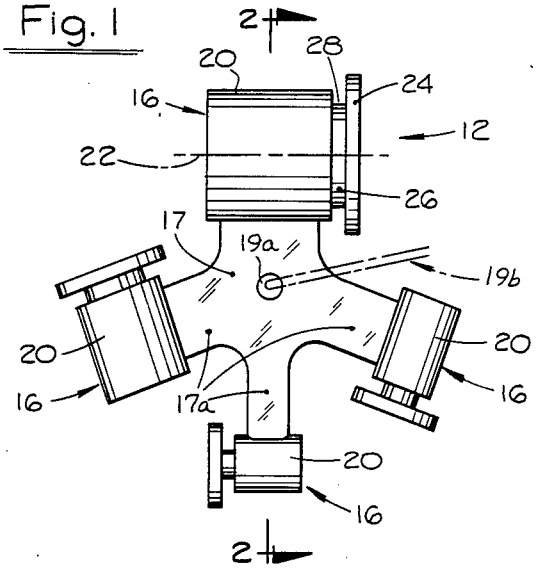
FIG. 1 is a side view of the fuse block out of the invention, embodying one form thereof.
Figure 2:
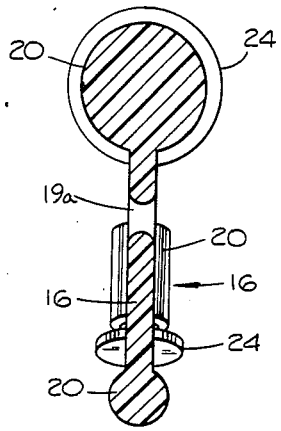
FIG. 2 is a sectional view taken at line 2—2 of FIG. 1.

The blocking elements 16 of the form of FIG. 1 are of the canister type and each includes a cylindrical main part or element 20 which is directly connected to the corresponding arm 17*a*. Each blocking element has an axis 22 so referred to for convenience, and the blocking elements are disposed generally tangential to the circumferential form of the block out.

Each blocking element 16 also includes a plate-like disc or enlargement 24 coaxial with the element 20 and being at the outer end of a stem 26, the stem being also coaxial with the element 20 and of lesser diameter than that element. Thereby a groove 28 is formed between the disc 24 and the element 20, having a bottom surface defined by stem 26. In all of the blocking elements, the depth of the groove is the same, regardless of the size of the element 20.

In the form of the device shown in FIG. 1, it includes four blocking elements 16 which, as indicated above, are of different sizes. These different sizes are to accommodate fuse clips that hold corresponding different sizes of fuses. In the construction and arrangement of the device itself, the arms 17*a* may be at such relative angular spacing as to accommodate various dimensions of the blocking elements 16, and thus need not be respectively aligned in diametrical direction. As will be referred to hereinbelow, in manipulating the device, the three blocking elements that are not to be active in any blocking position, serve as a handle or gripping means for the user in manipulating it.

Reference is next made to the fuse block 14. As indicated above, this fuse block is of known construction and includes a base 30 of box-like shape, and a pair of fuse clips 32 for holding the fuse. Each clip includes a pair of fingers 34 that are spring biased toward each other for releasably retaining the fuse 19 in position therein. They are mounted in the block 30 by screws 36 which also serve to secure the conductors 18 (FIG. 7) to the fuse clips. The fingers 34 of the fuse clip include inwardly directed protrusions 38 (FIGS. 5, 6) which enter into the groove 28 in the block out, as referred to again hereinbelow.

In the use of the device, the fuse 19 of the circuit concerned in the operation in question is removed (FIG. 3) for disabling the circuit or circuit portion concerned. Then the block out 12 is put in position, by merely positioning the selected blocking element 16 up to the clip and pushing the device against the clip. The blocking element is thereby snapped into position in the clip, and it is also positioned in axial direction (axis 22, FIG. 1) so that the protrusions 38 are aligned with the groove 28 and enter thereinto. When the device is so snapped into position, the fingers 32 grip around the element 20 and hold it therein, and the protrusions in the groove 38 retain it in position in axial direction.

The fuses 19 are made of different sizes and the provision of the blocking element 16 of different sizes, enable a single fuse block out to be used for any of those different sizes, up to four in this case. The other three blocking elements 16 that are not performing a blocking function in this step, together serve as a handle or gripping means for holding and manipulating the device. The fact of the various blocking elements 16 being spaced apart angularly, provide deep texture or roughened effect, facilitating gripping and holding the device.

The three blocking elements 16 that are not in use in a particular blocking step, of course extend outwardly away from the fuse block 14 and in such position provide a highly visible, and conspicuous, element which effectively warns the maintenance men. The three blocking elements that extend outwardly, while being of conspicuous nature visually, are relatively small from the standpoint of functioning of the overall electrial apparatus, that is, the device is relatively small to enable and facilitate closure of a cabinet that encloses the fuse blocks and block out.

Because of the size and shape of the device, the hole 19*a* is positioned at a convenient location enabling a workman to tie a danger tag thereon, by threading the string through the hole and tying it. Heretofore in the absence of such block outs, and when a fuse is removed and the fuse clip remains empty or vacant, the workman was expected to tie a name tag directly to the clip, by threading one of the strings through a hole or slot in the clip. The clip is relatively recessed, i.e. within the confines of the block 14, and it is difficult and nearly impossible, to tie the strings with the protective gloves on. Accordingly the workman would often remove his gloves in order to so tie the clip, with consequent danger, and in many cases receiving electrical jolts. However, in the present case the hole 19*a* (FIG. 1) is well exposed and accessible for the purpose.

Figure 8:
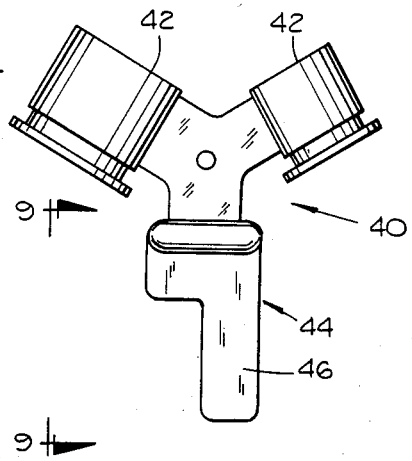
FIG. 8 shows the modified form of the device, being oriented according to FIG. 2.
Figure 9:
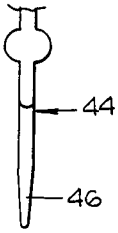
FIG. 9 is a view taken at line 9—9 of FIG. 8.

FIGS. 8 and 9 show a modified form of block out. The block, identified 40 includes two blocking elements 42 similar to the blocking elements 16 in the first embodiment, and a third blocking element 44 which is relatively elongated and includes a knife-like element, or blade, 46 for use in connection with fuse clips of corresponding shape and position. In other respects the fuse block out 40 of FIGS. 8, 9, possesses the features and advantages discussed above, in connection with the first form.

I claim:

1. A fuse block out for use in a fuse block having spring clips each with opposed fingers yieldingly biased toward each other for manually holding a fuse, comprising, a single integral piece having a body including at least one arm extending from the body, and the arm including, on its extended end, a blocking element insertable into one of the clips, in the space between said opposed fingers of that clip, to the exclusion of the insertion of a fuse thereinto, said body serving as a hand grip means for manipulating the piece.

2. A fuse block out according to claim 1 wherein, the body includes a plurality of arms extending in generally radial directions, each arm including a said blocking element, the blocking elements being of different sizes, for effective insertion into spring clips of different sizes, the arms other than the one in the spring clip in a mounted position, together constituting a hand grip for manipulating the piece.

3. A fuse block out according to claim 2 wherein, at least one of the blocking elements is of knife-type having a relatively flat blade for insertion into recessed knife-type fuse clips.

4. A fuse block out according to claim 2 wherein, the blocking elements include at least one of canister type, having a cylindrical main part with a circumferential groove therein, the groove being adapted for extension thereinto of a protuberance on the spring clip for preventing shifting movement of the piece in the direction of the cylindrical axis.

5. A fuse block out according to claim 4 wherein, all of the blocking elements are of canister type, each including a main part and a circular plate-like enlargement spaced axially from the main part by a reduced stem of smaller diameter than the main part, said groove thereby being positioned between the enlargement and the main part.

6. A fuse block out according to claim 5 wherein, all plate enlargements are of the same absolute dimension greater than the related main part, and all grooves are of the same absolute dimension less than the related main part, regardless of the sizes of the respective blocking elements.

7. A fuse block out according to claim 1 wherein, the piece is of molded plastic of high dielectric strength.

8. A fuse block out according to claim 7 wherein, the piece is of red danger-indicating color, and the body is provided with a hole therethrough, adapted for tying of a danger tag to the piece, the hole being adjacent the center of the piece and thereby being in position displaced from the spring clip in which the block is mounted, in any position the block out assumes when any of the blocking elements is mounted in a spring clip.

* * * * *